US006780064B2

(12) United States Patent
Abel et al.

(10) Patent No.: US 6,780,064 B2
(45) Date of Patent: Aug. 24, 2004

(54) MODULAR ANALYTICAL SYSTEM HAVING AT LEAST TWO MODULES CONNECTED BY A CONNECTING PLUG

(75) Inventors: Guido Abel, Mannheim (DE); Friedrich Ackermann, Heildelberg (DE); Manfred Augstein, Mannheim (DE); Wolfgang Fabian, Mannheim (DE)

(73) Assignee: Roche Diagnostics Operations, Inc., Indianapolis, IN (US)

( * ) Notice: Subject to any disclaimer, the term of this patent is extended or adjusted under 35 U.S.C. 154(b) by 0 days.

(21) Appl. No.: 10/192,826

(22) Filed: Jul. 9, 2002

(65) Prior Publication Data

US 2003/0124911 A1 Jul. 3, 2003

(30) Foreign Application Priority Data

Jul. 18, 2001 (DE) ..... 101 34 885

(51) Int. Cl.[7] ..... H01R 9/22

(52) U.S. Cl. ..... 439/717; 439/594; 439/701; 439/952; 439/507

(58) Field of Search ..... 439/717, 701, 439/594, 952, 507, 502, 67, 493, 640, 509

(56) References Cited

U.S. PATENT DOCUMENTS

| | | | | | |
|---|---|---|---|---|---|
| 2,253,971 | A | | 8/1941 | Dodge et al. | 62/89 |
| 3,701,078 | A | * | 10/1972 | Lynch | 439/329 |
| 3,806,767 | A | * | 4/1974 | Lehrfeld | 361/803 |
| 4,245,876 | A | * | 1/1981 | Ritchie et al. | 439/590 |
| 4,401,351 | A | | 8/1983 | Record | |
| 4,420,794 | A | * | 12/1983 | Anderson | 361/809 |
| 4,502,098 | A | * | 2/1985 | Brown et al. | 361/690 |
| 4,780,098 | A | * | 10/1988 | Seidler | 439/876 |
| 4,950,178 | A | | 8/1990 | Harvey et al. | 439/507 |
| 5,074,157 | A | | 12/1991 | Marsoner et al. | 73/864.81 |
| 5,145,398 | A | | 9/1992 | Manabe | 439/341 |
| 5,249,979 | A | | 10/1993 | Deinhardt et al. | 439/341 |
| 5,427,546 | A | * | 6/1995 | Garritano et al. | 439/502 |
| 5,466,172 | A | * | 11/1995 | Carstens et al. | 439/509 |
| 5,584,724 | A | | 12/1996 | Shibata et al. | 439/507 |
| 5,746,976 | A | | 5/1998 | Yamada et al. | 422/62 |
| 5,804,971 | A | | 9/1998 | Cumming et al. | 324/438 |
| 5,820,549 | A | | 10/1998 | Marian, Jr. | 600/437 |
| 5,839,922 | A | * | 11/1998 | Orlando et al. | 439/717 |
| 6,010,373 | A | * | 1/2000 | Donahue | 439/717 |
| 6,135,801 | A | | 10/2000 | Helot et al. | 439/341 |
| 6,421,250 | B1 | * | 7/2002 | Kim et al. | 361/784 |

FOREIGN PATENT DOCUMENTS

| | | |
|---|---|---|
| DE | 1806586 | 5/1970 |
| DE | 3633785 A1 | 4/1988 |
| DE | 3818148 A1 | 1/1989 |
| DE | 19854096 A1 | 5/2000 |
| DE | 19917398 A1 | 10/2000 |
| DE | 10106996 A1 | 9/2002 |
| EP | 0671184 A1 | 9/1995 |
| EP | 0780134 A1 | 6/1997 |
| WO | WO 95/26796 | 10/1995 |
| WO | WO 96/28858 | 9/1996 |
| WO | WO 00/05581 | 2/2000 |
| WO | WO 00/14496 | 3/2000 |
| WO | WO 00/36410 | 6/2000 |

* cited by examiner

*Primary Examiner*—Tho D. Ta
(74) *Attorney, Agent, or Firm*—Brian L. Smiler; Roche Diagnostics Operations, Inc.

(57) ABSTRACT

The invention concerns an analytical system in which at least two modules are in contact with one another by a connecting plug, and a connecting plug which is suitable for connecting modules. When two modules are connected by the connecting plug a part of the plug extends partially underneath the bottoms of the modules such that the plug connection is secured by the dead weight of the modules.

17 Claims, 3 Drawing Sheets

Figure 1:
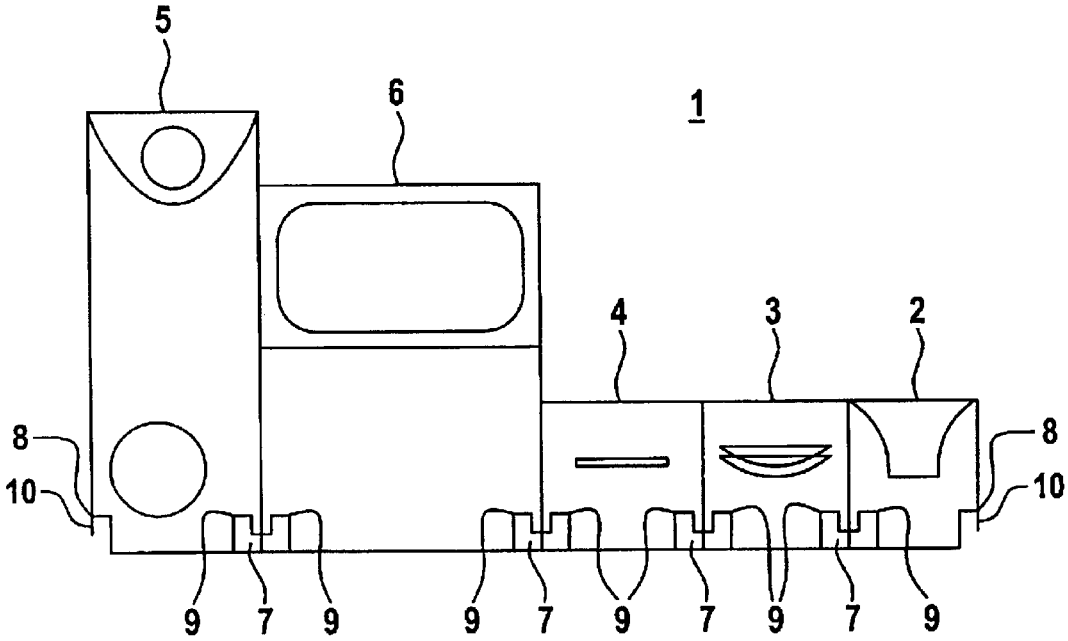

MODULAR ANALYTICAL SYSTEM HAVING AT LEAST TWO MODULES CONNECTED BY A CONNECTING PLUG

The invention concerns an analytical system in which at least two modules are in contact with one another by means of a connecting plug.

A connection of several modules is frequently used for tailor-made modular instrument systems. Such instrument systems must meet requirements in accordance with the respective field of application. Some fields of application which have a tailor-made set of requirements are for example in the fields of medicine and diagnostics in which highly specialized analyzers are often used. In these fields the analyzers have to meet very high standards and have specific performance characteristics, and many of these requirements cannot be achieved with a single analyzer. The manufacture of such specific instruments is complicated and expensive and hence it is desirable to use the instruments to their full capacity. Other instruments are often necessary in addition to the analyzers which are used to process and output data. A plurality of instruments which are required simultaneously form a modular analytical system. Depending on the field of application there may be different requirements for the analytical system since for example different parameters have to be determined in order to analyse different diseases. As a consequence the number and type of analyzers in a modular analytical system varies. It is therefore desirable to be able to combine several analyzers to form an analytical system for a particular field of application. Thus for example analyzers which are not required for standard analyses can be added to the analytical system as required. The flexible use of analyzers in a system thus requires an adapted solution with regard to the field of application which ensures that highly specialized analytical systems are provided and improves the utilization of instruments. Furthermore a central control of the analytical system can avoid additional costs since for example elements of the user interface (monitors, loudspeakers, printers etc.) do not have to be provided for each individual analyzer but instead a central control provides a contact of these elements to the respective module. In addition to a spatial combination of the instruments, such a central control unit allows the modules to be in contact with one another and hence allows an exchange of information. In addition to data exchange between a central control unit and the modules, an information exchange between the instruments can take place resulting in a further simplification of the system handling.

Modular instrument combinations which are for example frequently used in the analytical field are known in the prior art. A specific embodiment in the prior art is based on the use of a central unit which has a connection for various modules. Only one module can be connected to this central unit and thus a major disadvantage of these instrument systems is that it is not possible to simultaneously contact several modules.

A simultaneous combination of several instruments is achieved in the prior art for example by rack-like slide-in units (U.S. Pat. No. 5,746,976). However, a disadvantage of such solutions using slide-in units is that the maximum number of instruments that can be used at the same time is predetermined and the design and the handling of the modules is limited by such a use resulting in very high demands on the geometry of the modules.

The document EP 0 780 134 describes a connection of instruments which is achieved by plugs that are integrated into the instrument housing. Hence such a connection also makes high demands on the structure of the modules, the housings of which have to be constructed to match one another.

Furthermore a mechanical locking and electronic contact between modules is reported in the documents WO 9628858, U.S. Pat. No. 5,145,398. The modules can be connected together by means of plugs by a turning motion. In order for the instruments to turn relative to one another, the plugs of the modules are attached to the upper half of the respective sides of the instruments.

Major disadvantages of this embodiment arise from the connection of the modules by a turning motion and this makes it much more difficult to exchange an instrument in the combined unit. Furthermore a turning motion is not possible for many instruments which for example have containers for liquid waste or storage. In addition the construction requires that the instruments are arranged at the same height to enable a connection of the plugs on the upper side of each instrument.

Moreover the plugs have to be precision made since an angular misalignment in one instrument connection would be propagated when subsequent instruments are connected. This makes it difficult to combine a plurality of instruments. Plugs on the outer instruments of the analytical system remain unused on one side and are thus exposed to contamination.

The object of the invention is to provide a combination of modules which allows an easy-to-handle replacement of an instrument in the combined system. Furthermore it should be possible to combine any number of instruments without significant limitations on their shape or functionality.

The invention is characterized by a connection of modules which allow a simple removal or addition of a module.

The modular analytical system comprises a first module with a first interface which is located in a recess in the first module, the recess extending upwards from the bottom face of the first module into the interior of the module, and a second module with a second interface which is located in a recess of the second module, the recess extending upwards from the bottom face of the second module into the interior of the module. The modular analytical system additionally comprises a connecting plug to connect the first and second module which has a first plug part for connection to the first module which has an upwardly directed plug portion with an interface that fits the first interface and a plug portion which is connected to the lower area of the upwardly directed plug portion which extends at least partially below the bottom of the first module when the first plug part is inserted, and has a second plug portion for connection to the second module which has an upwardly directed plug portion which has an interface that fits the second interface and has a plug portion which is connected to the lower portion of the upwardly directed plug portion and extends at least partially below the bottom of the second module when the connecting plug is inserted.

However, the modular analytical system can also optionally comprise a first module with a first interface which is located in a downwardly directed part of the first module, said part extending above the bottom face of the first module, and a second module with a second interface which is located in a downwardly directed part of the second module, extending above the bottom face of the second module. Such a modular analytical system comprises a connecting plug to connect the first and second module which has a first plug part for connection to the first module which has a recess containing an interface that fits the first interface and a portion which extends at least partially below the bottom of the first module when the first plug part is inserted and a second plug part for connection with the second module which has a recess containing an interface that fits the second interface and a portion which extends at least partially below the bottom of the second module when the second plug part is inserted.

The use of such modular analytical systems enables a simple assembly or/and removal of instruments at any desired position in the analytical system and the system can be extended at will. The plug connector systems are characterized by their robustness and cost-effective manufacture, since they should have a high tolerance. The connection of the modules does not pose any significant constraints on the modules with regard to shape or functionality such as limitations in the handling of the sample transport or of the structure or arrangement of the measuring chambers. The modules can be of any shape and only have to have a plug or plug opening according to the invention on the underside of the instrument as a special feature. Furthermore the plug connector system located at the bottom is shielded from contamination from the surroundings due to its position and hence no special measures are needed to protect an unused interface.

In both embodiments of the system the first and second plug parts are permanently connected in a preferred manner such that an inserted plug connector fixes the position of the first module relative to the second module. Such a connection between modules fixes the modules relative to one another such that only one movement of the modules relative to one another in one direction in space enables a module to be simply removed or added. In addition the connecting plug may be attached to a support such that modules connected thereby are locked in position by the support. The use of such systems is particularly suitable for analytical systems that have to be frequently transported since this ensures simpler handling during transport. If the analytical system is additionally locked in position by a support, such a support could, for example, be a trolley.

However, it is also possible for the first and second part of the plug to be joined together via a flexible region, such that when the plug connector is inserted the first and second module can be positioned relative to one another within limits determined by the flexible region that can be chosen freely.

In the embodiments according to the invention the plug portion extends at least partially below a module and is adapted to the respective module in such a manner that at least a part of the underside of the plug rests on a surface on which the module is placed. As a result the weight of the module additionally fastens the connection between the module and the plug.

A plug connector can preferably be equipped with a module connector for power supply and/or for signal transmission and with an inter-module connector for fluids. Such connections allow, for example, a central control of the analytical system and thus a simplified handling for the user. This is facilitated in a preferred embodiment in which the analytical system comprises a module which has a display and/or an input unit and/or at least one analytical module, and at least one input/output module. Hence it is for example possible to dispense with additional output modules (e.g. printer, screen etc.). Furthermore this, for example, allows the direct processing and transmission of analytical data which are communicated to the user in a desired form. In addition it is possible to automate processes such that the operator for example does not have to enter certain commands.

Electrically conducting connections within the connecting plug are for example connected to the modules for example by means of spring-mounted contacts. If these connections are used for voltage supply, they preferably form a series connection with the modules whose electrical circuit is closed via the housing of the instruments or another electrical connection. In this case it is also conceivable that a power unit is integrated into the connectors which transforms the applied voltage if required. If the module has its own power supply, the voltage can be passed through the instrument without being tapped.

Signals can also be transmitted via electrical connections. However, other types of connection are possible such as light wave guides for transmitting optical signals. The connecting plug can also contain electronic componentry in a preferred manner which allows signal transformation. Since such a function can be used specifically for modules it can for example force a correct combination of the modular analytical system by a key-lock principle of the modules with regard to appropriately designed connecting plugs.

The ability to add a module by moving the modules relative to one another only in one direction in space allows, in a preferred embodiment, the use of known principles of card and bus systems (e.g. PCMCIA). In this case the order of possible plug functions is determined by the different heights of the contacts between the module and the connecting plug. This for example prevents signal transmission before the voltage supply is ensured.

Such integrated leads for power supply or data exchange between modules avoid complicated separate ducts for cables and/or leads.

Furthermore the integration of connectors for fluids for example allows substances to be transported between the modules such that, for example, sample material and/or compressed air or rinsing liquid for cleaning the modules can be passed successively through the instruments.

Consequently it is possible to automate the operation of the analytical systems in a user friendly manner. In principle the number of connections used is not limited and enables any number of applications. In addition if the analytical system is attached according to the invention to a support it is conceivable that the connections are disposed within the support. This embodiment appears appropriate particularly when there are a large number of connections.

In order to achieve an embodiment which is as cost-effective and easy to handle as possible, it is advantageous when the upwards extending recess of the first and/or second module has a rectangular cross-section and that the interface is at the upper end of the recess. If a first and/or second module, for example, have at least two interfaces, symmetrically identical interfaces prove to be advantageous. Hence the operator is able to combine several modules without difficulty. The at least two interfaces for one and/or more modules preferably also enable passage of current and/or signals.

The invention also concerns connecting plugs to connect modules of an analytical system in which a connecting plug has a first plug part for connection to a first module, which has an upwardly directed plug portion in the plugged state, and a plug portion which extends perpendicular to this plug portion and is connected thereto, and a second plug part for connection to a second module which has an upwardly directed plug portion in the plugged state and a plug portion which extends perpendicular to this plug portion.

In addition the invention encompasses a connecting plug for connecting modules of an analytical system which has a first plug part for connection to a first module with a recess and an interface located in the recess, and a second plug part for connection to a second module with a recess containing an interface located in the recess.

According to the invention the respective embodiments of the connecting plugs can be used to connect and position a first and a second module.

The respective embodiments of the plug for example contain a first and a second plug portion which are rigidly or flexibly connected to one another. If the plug has a flexible region it is possible to freely select, within limits defined by the flexible region, the relative positioning of the first and second module when the connecting plug is inserted.

FIG. 1: Analytical system which is composed of several connected modules.

Figure 2:
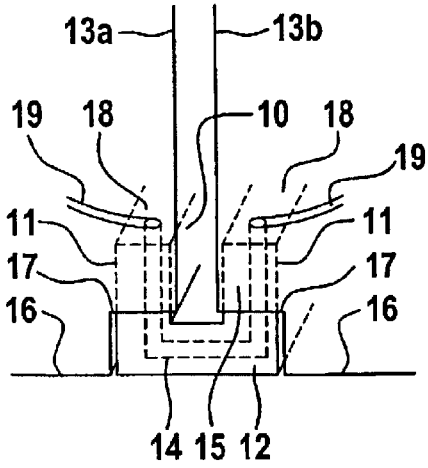

FIG. 2: Connection of two modules by a connecting plug having an upwardly directed plug portion.

Figure 3:
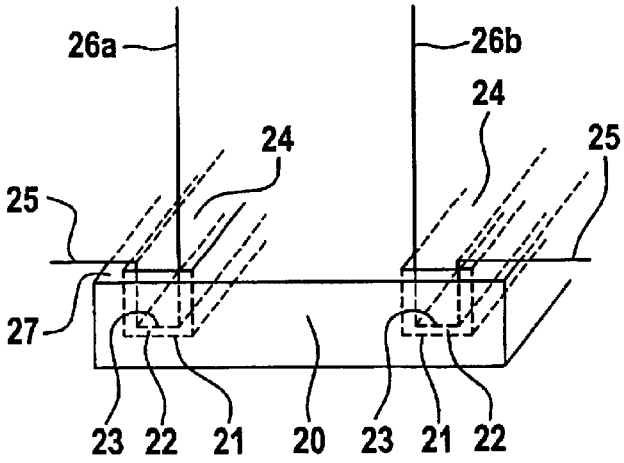

FIG. 3: Connection of two modules by a connecting plug having recesses in the plug portion.

Figure 4:
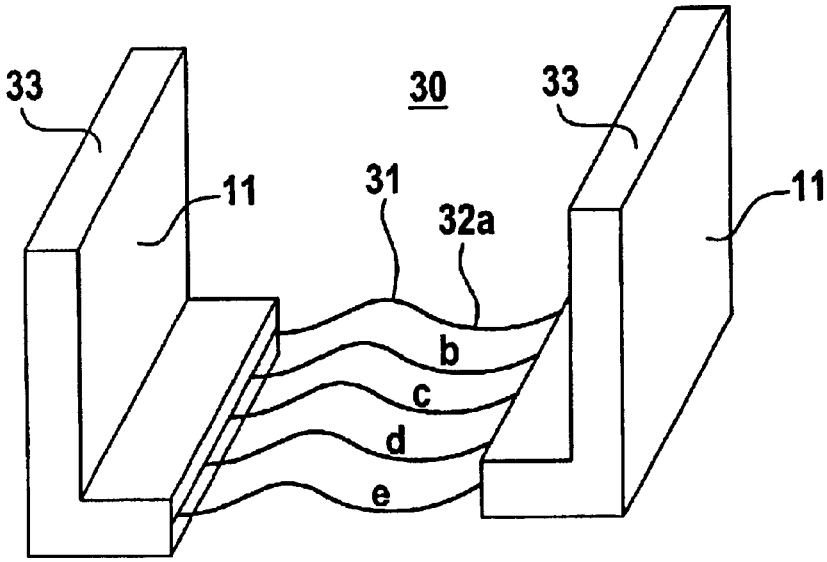

FIG. 4: Connecting plug in which the upwardly directed plug portions are joined together by a flexible region.

Figure 5:
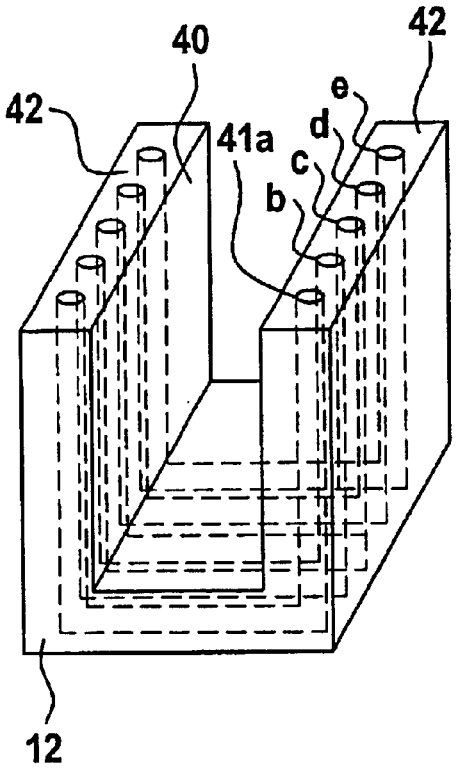

FIG. 5: Connecting plug which contains different connecting channels.

Figure 6:
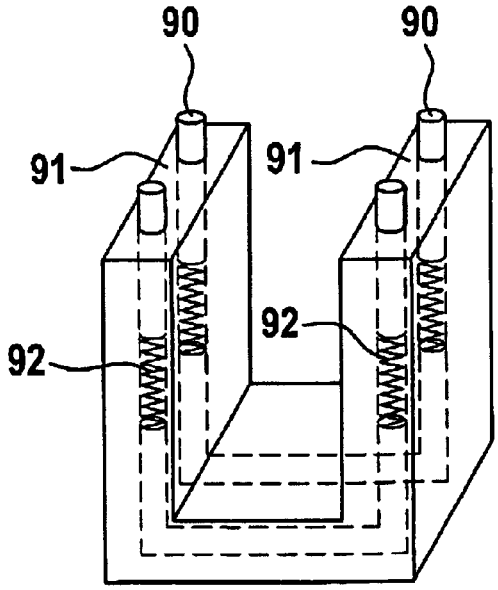

FIG. 6: Connecting plug which is used as a support for a module.

Figure 7:
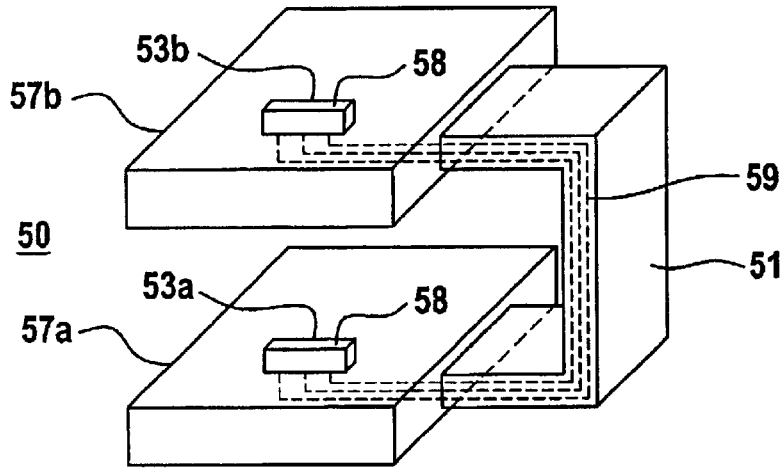

FIG. 7: Connecting plug with spring-mounted contacts.

Figure 8:
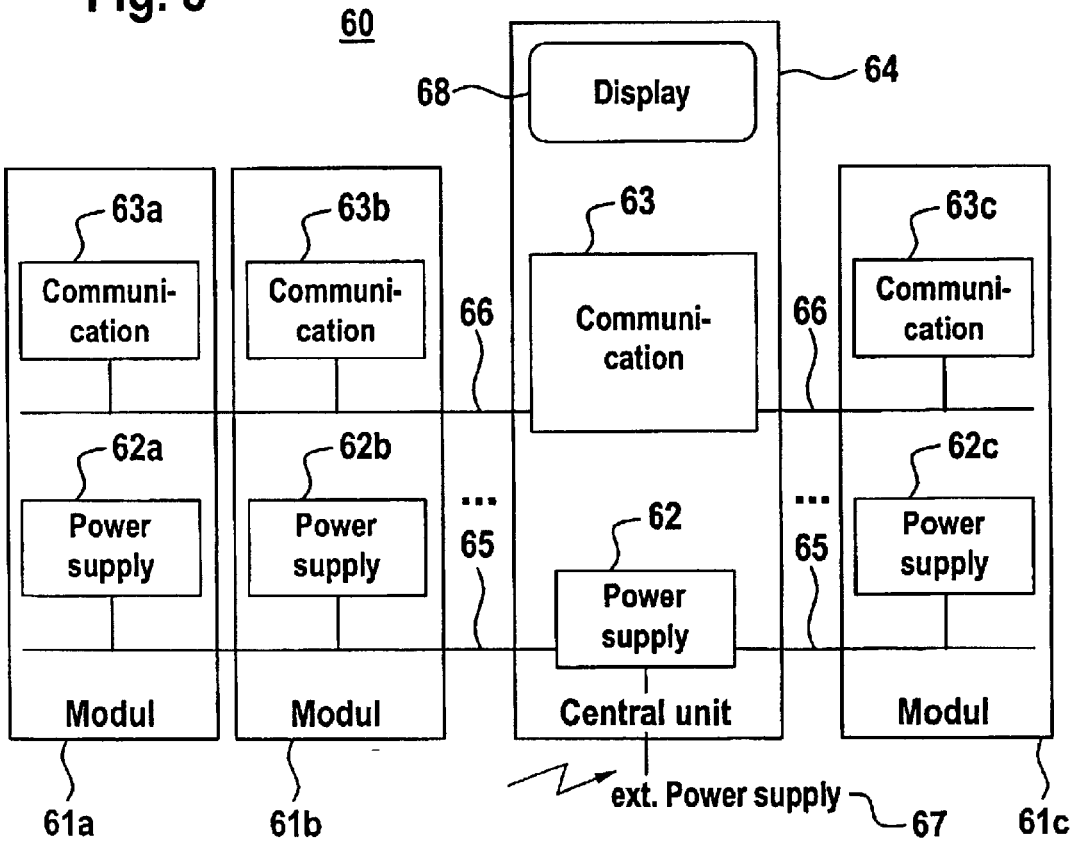

FIG. 8: Analytical system which is composed of several connected modules which allow information exchange.

FIG. 1 shows an example of an analytical system (1) that is used to determine the glucose concentration, blood gas concentration and coagulability of blood. The analytical system consists of a glucose measuring instrument (2), a blood gas analyser (3), a coagulation instrument (4), a computing unit (5) and a screen (6).

The respective modules are connected together and positioned relative to one another by means of connecting plugs (7). Each of the instruments shown has two interfaces (9) and are in series communication with one another by means of two connecting plugs each. The modules can also be arranged at right angles to one another or form a network structure depending on the arrangement and number of interfaces (9) in a module. The combination of the modules shown is selected as an example and can be extended or altered as desired. Each of the modules that are on the outside of the analytical system has a free interface (8). Potential contamination is substantially prevented due to the protected position of the interface by the wall of the instrument (10). In FIG. 1 the connecting plugs have for example a U-shape with two upwardly directed plug portions. The recesses of the interfaces (9) in the bottom of the modules have a complementary shape. The plug and recess are rectangular. The connection between the systems is essentially not subjected to mechanical strain and does not have to fulfil any special requirements. The plug connection system is hence characterized in that it is particularly simple and cost-effective to manufacture.

FIG. 2 illustrates the connection of two modules (13*a, b*) by means of a connecting plug (10) as shown in FIG. 1. The connecting plug (10) has a U-shape with two upwardly directed plug portions (11) and a horizontal plug portion (12). The upwardly directed plug portions (11) have interfaces (18) which are connected together by means of a connecting channel (14) and are in communication with the connecting channels of the modules (20). The interface of the module is located in a recess (15) of the module and is compatible with the plug. The recess (15) extends from the bottom (16) of the module into the interior of the module and is of such a size that the bottom (16) of the module forms a common plane with the perpendicular plug portion (12). Consequently a part of the perpendicular plug portion (12) extends below the bottom (17) of the module. This plug portion and the bottom surface (16) of the modules rest on the same sub-floor. The intrinsic weight of the modules acts via the instrument interface on the perpendicular plug portion (12) to strengthen the connection between the modules and the plug. The connection between the plug and the module can be detached by lifting the module and can be reconnected by lowering the instrument onto the upwardly directed portion of the plug (11). This simple mechanism enables an easy-to-handle exchange of modules at any desired position in a combination of instruments. The neighbouring instruments are uninfluenced by this process. The process makes no particular demands on the exchanged module which would influence the functionality (e.g. instruments with liquid containers etc.). In addition the connection of the modules at the bottom of the instruments does not make any constraints on the positioning of the modules relative to one another (e.g. arrangement of the instruments at the same level).

In contrast to the system shown in FIGS. 1 and 2, the plug (20) in FIG. 3 contains two recesses (21) which extend into the interior of the plug and have an interface (22). The recesses (20) have, for example, a rectangular shape. They are in communication with the interfaces (23) of the modules (26*a, b*) via the interfaces (22). The interfaces (23) are located on a part (24) of the module which is compatible with the recess (22) which extends downwards from the bottom (25) of the module. Part of the bottom (25) rests on the surface (27) of the plug. The principle of the plug connecting system is similar to the mechanism shown in FIGS. 1 and 2 such that here the dead weight of the modules acts on the connecting plug and secures the connection. The module can be exchanged from the instrument system in an identical manner with both plug connecting systems.

FIG. 4 shows a connecting plug (30) which is similar to the representation of the connecting plug in FIG. 2, except that the vertical plug portion (12) in FIG. 4 contains a flexible element (31). This flexible element (31) is for example composed of several cables (32*a–e*) and connects the upwardly directed plug portions (11). The function of these cables can for example be to exclusively ensure a flexible construction and use of the connecting plug, but it can also enable a data transfer. Under these circumstances the cables have to be in contact with the interfaces (33). In this manner information can be exchanged between two modules via an instrument interface. This can be for example used to forward data to a central control unit or computing unit. However, it is also conceivable that data from one module e.g. an analytical instrument are registered and processed.

FIG. 5 shows the paths of several connecting channels (41*a–e*) within a plug (40). The connecting channels (41*a–e*) connect the respective interfaces (42) of the plug and are for example represented in FIG. 4 as cables. The connecting channels communicate with the modules via the interfaces (42). The U-shaped plugs for example contain a rigid perpendicular plug portion (12) as already shown in FIG. 2 but it can also be a flexible element (31). The connecting channels can be used for communication between the modules or to forward information to a central unit. The type of transmitted information depends among others on the design of the connecting channels. Thus for example connections for fluids can also be provided which enable the transport of substances between two modules.

FIG. 6 shows an embodiment of the plug with spring-mounted contacts (90). The contacts protrude in the noncontacted state beyond the interface (91). Under the counterpressure of a module in the contacted state, the springs (92) are pressed together to such an extent that a secure contact is ensured between the plug and module. Hence the plug connecting system also enables a secure contact even with high production tolerances.

FIG. 7 shows a connecting plug (50), whose arm (57*a*) is connected by means of a cross-piece (51) with a second arm (57*b*). The shape of the plug thus again corresponds to a U which is rotated by 90° and one arm of which forms a support for mounting the modules. The arms (57*a* and *b*) each have a rectangular attachment (53*a, b*) which have interfaces (58) on their surfaces. In the figure these interfaces are connected to connecting channels (59) which run through the arms (57*a, b*) and the cross-piece (51) and connect the rectangular attachment (53*a*) with the rectangular attachment (53*b*). In principle such a connecting plug (50) is also conceivable without connecting channels (59).

The properties of an analytical system (60) according to the invention are shown schematically in FIG. 8 by way of example. The modules (61*a, b, c*) each have a power supply unit (62*a, b, c*) and a communication unit (63*a, b, c*). All modules are in communication with a central unit (64) by means of the communication units (63) and power supply unit (62). The central unit (64) is connected to an external power supply with a power supply unit (67) such that the modules (61) are directly connected to external power via respective communication channels (65) between the power supply units (62) and (67). The respective modules can exchange data by means of the respective connecting channels (66) between the communication units (63*a, b, c*) or can forward data directly to the communication unit in which the data are processed. The operator receives the data via a screen (68).

Such an analytical system (60) is for example suitable for determining the blood gas concentration, the coagulability of the blood, the blood glucose and certain proteins which serve as markers for cardiac infarction. The analytical system comprises a measuring instrument for determining blood glucose (61*a*), an instrument for measuring cartridges for determining the coagulability (61*b*), a blood gas analyzer (61*c*) and the central unit (64). In all measuring modules shown, the blood either has to be applied to strips or to cartridges which have to be inserted into the measuring instruments (61*a, b, c*) or are taken up by a special small syringe. The measuring modules automatically carry out all evaluations of the crude data to finally produce the laboratory result. This is reported to the central unit which displays it to the operator on the screen (68).

What is claimed is:

1. A modular analytical system, comprising:

a first module having a first interface located in a recess of the first module, the recess extending upwards from the bottom face of the first module into the interior of the module, a second module having a second interface located in a recess of the second module, the recess extending upwards from the bottom face of the second module into the interior of the module, and a connecting plug to connect the first and second modules, the connecting plug comprising a first plug part for connection to the first module having an upwardly directed plug portion with an interface that fits the first interface and a plug portion which is connected to the lower portion of the upwardly directed plug portion and extends at least partially below the bottom of the first module when the first plug part is inserted, and a second plug part for connection to the second module having an upwardly directed plug portion with an interface that fits the second interface and a plug portion which is connected to the lower portion of the upwardly directed plug portion and extends at least partially below the bottom of the second module when the connecting plug is inserted;

wherein the plug portion that extends at least partially below a module and the respective module corresponds in such a manner that at least part of the underside of the plug portion lies on a surface on which the module rests.

2. The system of claim 1, wherein the first and second plug parts are permanently connected together and the positioning of the first and second module is determined by the connecting plug.

3. The system of claim 1, wherein the first and second plug parts are joined together via a flexible region such that when the plug connector is inserted the first and second module can be positioned relative to one another within freely chosen limits determined by the flexible region.

4. The system of claim 1, wherein the connecting plug connects the modules for power supply as well as for signal transmission.

5. The system of claim 1, wherein the connecting plug allows fluid connection between the first and second module.

6. The system of claim 1, wherein the recesses of the first and second modules that extend upwards have a rectangular cross-section and the interfaces are located at the upper end of the recesses.

7. The system of claim 1, wherein the first and second modules have at least two interfaces.

8. The system of claim 7, wherein the interfaces are geometrically identical.

9. The system of claim 7, wherein current and signals are passed between the interfaces of the first and second modules.

10. A modular analytical system, comprising:

a first module having a first interface located in a downwardly directed part of the first module, the downwardly directed part extending above the bottom face of the first module, a second module having a second interface located in a downwardly directed part of the second module, the downwardly directed part extending above the bottom face of the second module, and a connecting plug to connect the first and second module, the connecting plug comprising a first plug part for connection to the first module having a recess containing an interface that fits the first interface and a portion which extends at least partially below the bottom of the first module when the first plug part is inserted, and a second plug part for connection to the second module having a recess containing an interface that fits the second interface and a portion which extends at least partially below the bottom of the second module when the second plug part is inserted;

wherein the plug portion that extends at least partially below a module and the respective module corresponds in such a manner that at least part of the underside of the plug portion lies on a surface on which the module rests.

11. The system of claim 10, wherein the first and second plug parts are permanently connected together and the positioning of the first and second module is determined by the connecting plug.

12. The system of claim 10, wherein the first and second plug parts are joined together via a flexible region such that when the plug connector is inserted the first and second module can be positioned relative to one another within freely chosen limits determined by the flexible region.

13. The system of claim 10, wherein the connecting plug connects the modules for power supply as well as for signal transmission.

14. The system of claim 10, wherein the connecting plug allows fluid connection between the first and second module.

15. The system of claim 10, wherein the first and second modules have at least two interfaces.

16. The system of claim 15, wherein the interfaces are geometrically identical.

17. The system of claim 16, wherein current and signals are passed between the interfaces of the first and second modules.

* * * * *